United States Patent [19]

Crowley

[11] 4,198,557

[45] Apr. 15, 1980

[54] CONTROL SWITCH FOR HAIR DRYER

[75] Inventor: George C. Crowley, Winnetka, Ill.

[73] Assignee: Sunbeam Corporation, Chicago, Ill.

[21] Appl. No.: 814,499

[22] Filed: Jul. 11, 1977

[51] Int. Cl.[2] ..... A45D 20/24

[52] U.S. Cl. ..... 219/370; 34/97; 34/243 R; 132/9; 219/364; 219/367; 219/373; 219/368; 219/379

[58] Field of Search ..... 219/361, 363, 364, 367, 219/369, 370, 37 B, 374, 379, 240, 241; 34/96–98, 243; 132/7, 9, 11; 417/411

[56] References Cited

U.S. PATENT DOCUMENTS

| | | | |
|---|---|---|---|
| 2,591,669 | 4/1952 | Bucknell et al. | 219/370 |
| 3,086,698 | 3/1963 | Goldstein | 417/411 |
| 3,397,463 | 8/1968 | Laing | 34/97 |
| 3,846,047 | 11/1974 | Wada et al. | 219/370 |
| 3,981,314 | 9/1976 | Barradas | 34/97 |
| 3,986,272 | 10/1976 | Feierabent | 219/370 |

FOREIGN PATENT DOCUMENTS

| | | | |
|---|---|---|---|
| 633023 | 1/1928 | France | 34/243 R |
| 955965 | 4/1964 | United Kingdom | 219/370 |

*Primary Examiner*—B. A. Reynolds
*Assistant Examiner*—Bernard Roskoski
*Attorney, Agent, or Firm*—George R. Clark; Neil M. Rose; Clifford A. Dean

[57] ABSTRACT

A hair drying appliance having a cylindrical housing and a handle rotatably mounted at one end for movement between a pistol-grip position and a position in alignment with the housing. The housing has two air outlets with heated air being directed through one outlet when the handle is in its pistol-grip position and through the other outlet when the handle is in its aligned position. A single electric switch for a heater means in the housing has a plurality of heat settings being available when the handle is in its pistol-grip position but with the range of heat settings being automatically limited to the lower heat settings when the handle is in its aligned position.

5 Claims, 6 Drawing Figures

6.
6.
11
11a
18
14
57
64
34
39
37
35
80
74
73
75
83
81
55
67
61
62
89c
89d
90
98c
99
91
94
93
23
95
89b
89a
85a
12a

MED
102
57
82
98c
99
93a
94
95
93
12a

HIGH
74
93
98d
94
99
95
82
93a
12a 11
11a
18
14
57
64
34
39
37
35
80
74
73
75
4.
93a
82
89d
98d
99
91
94
93
23
95
4.
81
55
60
67
89c
90
85a
89a
89b
56
61
62
83
12a
12

CONTROL SWITCH FOR HAIR DRYER

BACKGROUND OF THE INVENTION

Portable hand-held hair dryers with heated air outputs have been used extensively both by barbers and in beauty salons as well as by individuals in the home for many years. As the home market has increased in recent years, these appliances have developed primarily in two separate and distinct categories, the blower/dryers and the styler/dryers.

Blower/dryers are used primarily for drying the user's hair and provide a hot concentrated air flow. Such appliances typically have a cylindrical portion from which the hot air exits axially out one end thereof. The air outlet opening is relatively small and thus provides a high velocity concentrated air flow. With the high velocity air flow, the temperatures used in such blower/dryers can be extremely high without creating a risk of internal heat build-up by the heating elements and as such, the drying power of these devices is quite high. The most common blower/dryer configuration is the gun-type unit in which a handle portion extends downwardly at a right angle from the cylindrical body portion of the product. The motor and a centrifugal fan are positioned at the junction of the handle and body portion. Electrical heating elements are provided between the fan and the frontally located air outlet. Attachments such as a brush or comb cannot be used with such blower/dryers and, if brushing or combing is desired for styling, the consumer must use both hands, the blower being held in one and a brush or comb in the other. The gun-type configuration for a blower/dryer, however, is convenient to use and efficient if a second person is drying the actual user's hair, such as a professional hair stylist.

A styler/dryer appliance, on the other hand, is characterized by having various styling attachments, such as a brush or a comb, and typically has an elongated body with a head portion in which the hot air flow exits laterally therefrom. Thus, the appliance can be manipulated in the same fashion as is a common brush with one's hair being dried and styled as the user merely brushes or combs his or her hair. A typical construction of a styler/dryer incorporates a tangential fan within the head portion thereof with the heating elements being positioned between the fan and the lateral air outlet. Such a construction, additionally containing a water spray feature, is disclosed in the Churas et al U.S. Pat. No. 3,905,379. The air outlet contained in styler/dryers is of a larger area than that of the typical blower/dryer and consequently the air exits through this outlet at a lower velocity. This lower velocity and less concentrated air flow will not tend to adversely blow or scatter the user's hair as much as the high velocity air in the blower/dryer, thereby facilitating the styling operation.

The preferred and most efficient manner of preparing one's own hair would be to use a blower with its high temperature and concentrated air flow during the initial drying process and, after the hair has been partially dried, to use a styler/dryer to complete the drying and to properly style the user's hair. In view of these considerations, it would be advantageous to have a single portable hand-held product that would provide the functions and advantages of both a blower/dryer appliance as well as a styler/dryer appliance.

SUMMARY OF THE INVENTION

The present invention provides an improved hair drying appliance which can be used either as a gun-type blower/dryer or, in the alternative, as an elongated styler/dryer with attachments that can be placed on the side thereof. The invention includes a housing having an elongated cylindrical body portion and an elongated handle portion, each portion being attached to the other at one end. Within the main cylindrical body portion, there is provided an air inlet close to the handle end, a small air outlet at the opposite end and a larger air outlet on the side of this body portion. The body portion and the handle portion are rotatable with respect to each other so that one can have a gun-type or pistol configuration with these two portions at right angles to each other or, in the alternative, the handle portion can be rotated to a position in line with the main cylindrical body portion.

When the hair drying appliance of the present invention is used in its gun-type configuration, the hot air flow will exit through the air outlet at the front end and the product will be usable as a typical blower/dryer. In the alternative, the handle portion can be rotated to form an in-line configuration with the main body portion. When the appliance is in this latter configuration, attachments may be mounted on the unit. Each attachment comprises either a brush, comb, or similar hair grooming device, and also has a raised plate portion to block the front end air outlet. In this manner, with this front end blocked, the air flow through the body of the dryer will be directed out of the side-located air outlet and through the particular attachment being used. As such, the present invention can be used as a typical styler/dryer.

Various safety mechanisms have also been incorporated in the present invention including a locking member to secure the main body portion and the handle portion in their respective relative positions or configurations when the appliance is being used either as a blower/dryer or as a styler/dryer. This particular locking member additionally functions to prevent the consumer from using or attaching the grooming attachments when the appliance is in its gun-type blower/dryer configuration.

The present invention is characterized by an additional safety feature comprising a stop member incorporated with the electrical control switch of the appliance. This stop member prevents the highest wattage use of the dryer when it is in its in-line or styler configuration. This is desirable because with the styler configuration the air flow exiting laterally from the main body is not as great as with the unit in the blower/dryer configuration. By preventing use of the highest wattage in the styler configuration, there will be no damaging temperature rise within the unit. When the appliance is used in the gun-type or blower/dryer configuration, however, the aforementioned switch blockage is not created so that all levels of wattage may be employed.

It is an object of the present invention to provide an improved hair dryer which can be mechanically changed to assume two different configurations, one for use as a blower/dryer and the second for use as a styler/dryer, wherein multiple switch settings and corresponding wattages can be used in each hair dryer configuration.

It is another object of the present invention to provide a dual configuration hair dryer wherein a single electrical switch is used in both configurations yet the same range of operation of said switch is not permitted in each hair dryer configuration.

It is still another object of the present invention to provide an electrical switch assembly, which will provide a full range of operation for the electrical switch when the hair dryer is in its blower/dryer configuration and only a limited range of operation in the styler/dryer configuration.

Further objects and advantages of the present invention will become apparent as the following description proceeds and features of novelty which characterize the invention will be pointed out with particularity in the claims annexed to and forming a part of this specification.

DESCRIPTION OF THE PREFERRED EMBODIMENT

Figures 1, 2:
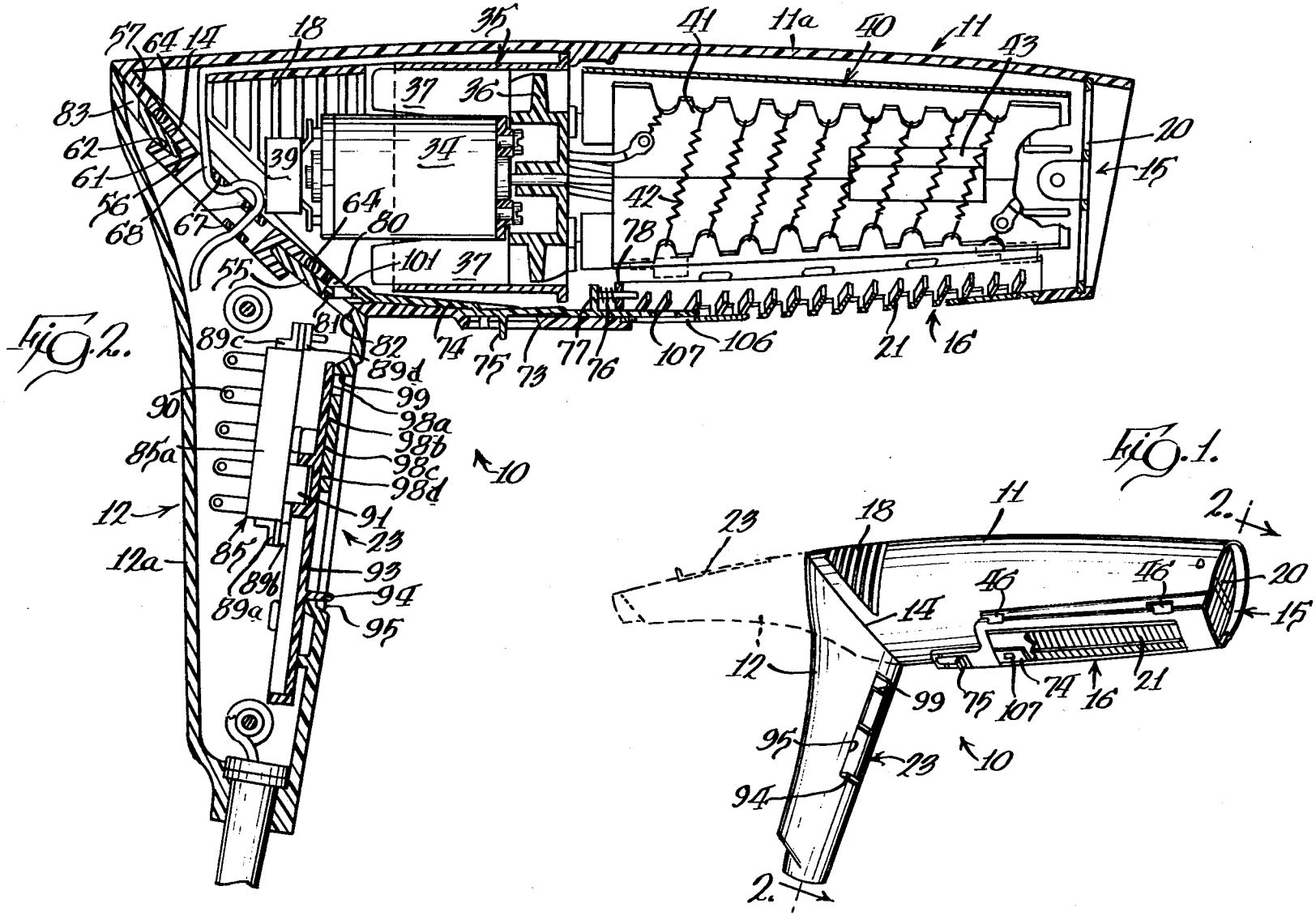
FIG. 1 is a perspective view of the hair drying appliance embodying the present invention with one configuration being shown in full line and with the alternative configuration being shown in dashed lines.
FIG. 2 is a longitudinal vertical sectional view taken generally on line 2—2 of FIG. 1.

Referring now to the drawings there is shown in FIG. 1 a hair dryer appliance designated generally by reference numeral 10. The hair dryer is shown in its blower/dryer or gun-type configuration with a handle portion 12, having a split plastic housing 12*a*, being positioned at a right angle with respect to a cylindrical body portion 11 having a split plastic housing 11*a*. Also shown in FIG. 1 in dashed lines is the styler/dryer configuration of the appliance 10 wherein the handle 12 is aligned with the cylindrical body portion 11. As will be described more fully below, the junction plane or swivel connection 14 between the handle and cylindrical body portions of the hair dryer appliance 10 is inclined at an angle of approximately 45° to the central axis of the body portion 11 so that the two different hair dryer configurations can be obtained by a mere rotation of the handle 12 about its own axis.

Toward the front end of the cylindrical body housing 11*a* there are located two hot air outlets 15 and 16, air outlet 15 being used with the hair dryer in its gun-type configuration and air outlet 16 being used in its styler configuration. An air inlet 18 is provided toward the back end of the body housing 11*a*. Metal protective grills 20 and 21 are provided covering the air outlets 15 and 16, respectively, in order to prevent hair, fingers, or any other objects from protruding into the cylindrical body portion 11 and toward the electrical heating elements contained therein.

In order to turn on the hair drying appliance 10 and to set it at its various heat levels and fan speeds, there is provided a control switch assembly 23. As shown in FIG. 1, the switch assembly 23 is positioned in the handle 12 so that the switch assembly will be positioned toward the front and inside of the hair dryer appliance while in the gun-type configuration. When the handle is rotated into the styler configuration the switch assembly 23 will be located at the top of the unit.

In order to secure the handle portion 12 against accidental displacement with respect to the body portion 11, there is provided a locking button 75 which will secure the handle 12 in proper position with respect to the cylindrical body portion 11 for the two alternative modes or configurations of the hair dryer. The structure and operation of the locking button 75 will be described hereinafter.

Inside the housing 11*a* there is contained a small D.C. motor 34 for driving a set of fan rotor blades 36 of an axial fan assembly 35. Surrounding the motor 34 and channeling the air flow from the air inlet 18 toward the fan rotor blades 36 are a set of fan stator blades 37. A standard diode bridge package 39 is attached to the back of the motor 34 and is used to convert the AC electrical supply to DC.

Within the housing 11*a* and forward of the fan assembly 35, there is secured a heating assembly 40, including several intersecting mica boards 41 which support hair dryer heating elements 42. The mica boards 41 and heating elements 42 are shown in section in FIG. 6. Centrally disposed within the heating assembly 40 is a thermostat 43 which prevents the temperature of the hair dryer appliance from exceeding a desired temperature level.

The cylindrical body portion 11 is constructed such that upon energization of the motor 35, the fan rotor blades 36 will rotate drawing air in through air inlet 18, through the stator blades 37, past the heating elements 42 and out through one of the air outlets. Without any obstructions, the air current pattern will carry the air flow axially along the cylindrical body portion 11 of the hair dryer 10, and out the air outlet 15. The vanes of grill 21 of the air outlet 16 are also slightly angled upwardly and forwardly, as shown in FIG. 2, to discourage and further deter air from exiting through the air outlet 16 when the hair dryer 10 is used in the gun-type configuration.

An attachment adaptor (not shown) is provided which is adapted to be secured to the cylindrical body portion housing 11*a* only when the handle 12 is rotated to its in-line position of its hair styler/dryer configuration. The adaptor, which is more fully described in two patent applications, each entitled Hair Dryer, filed concurrently herewith by Mr. George Crowley and Mr. Gordon Carlson and by Mr. George Crowley and Mr. Donald Jursich, respectively, and each assigned to the same assignee as the present invention, is secured to the housing 11*a* by four pegs or pins which fit into four bayonet-type slots 46, two each of which slots 46 are located on each side of the air outlet 16 provided in the hair dryer housing 11*a*. The front portion of the adaptor is also characterized by an upturned plate member which extends across the front end of the housing 11*a* and serves to block the air outlet 15 provided therein. Thus, when the adaptor is in position, the air flow will be directed or forced out through air outlet 16. For reasons that are fully described in the aforesaid concurrently filed applications, only after the adaptor has been detached from the body portion 11 can the handle portion 12 be rotated to its position generally perpendicular to the cylindrical body portion 11 whereby the hair dryer appliance 10 can be used as a typical gun-type blower/dryer with hot air exiting through the air outlet 15.

By rotating the handle 12 to its position in line with the cylindrical body portion 11 and by securing the adaptor thereto, the hair dryer appliance 10 can be used as a conventional styler/dryer with hot air being directed out through the air outlet 16, the air outlet 15 being blocked by the plate at the front of the adaptor. Various attachments, such as a brush or comb can be secured to the adaptor for use in styling the consumer's hair.

Figure 5:
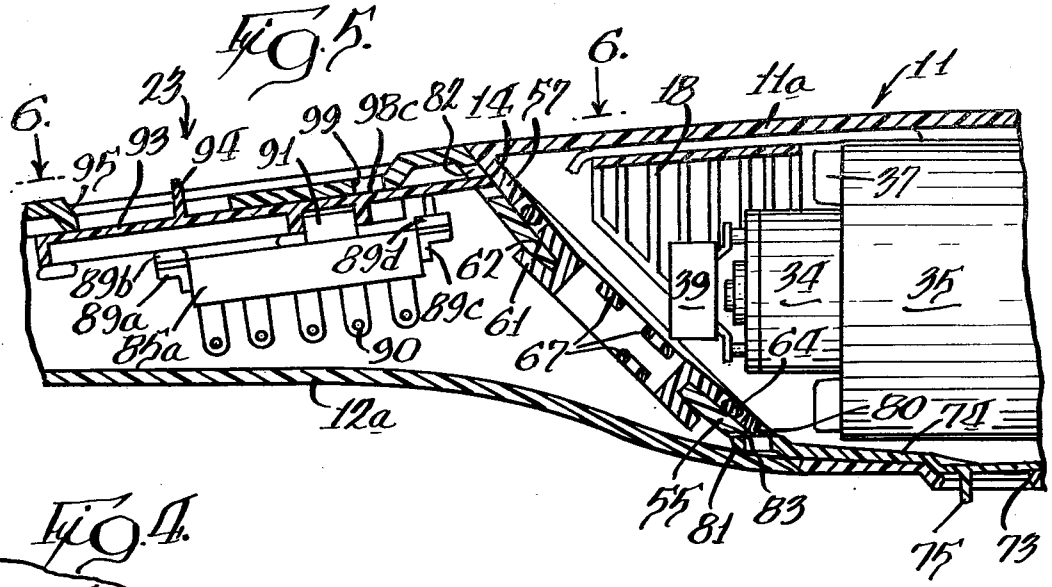
FIG. 5 is a partial longitudinal vertical sectional view similar to FIG. 2 with the hair drying appliance in its alternative configuration and with the switch assembly shown in its other high-wattage limit position.
Figure 3:
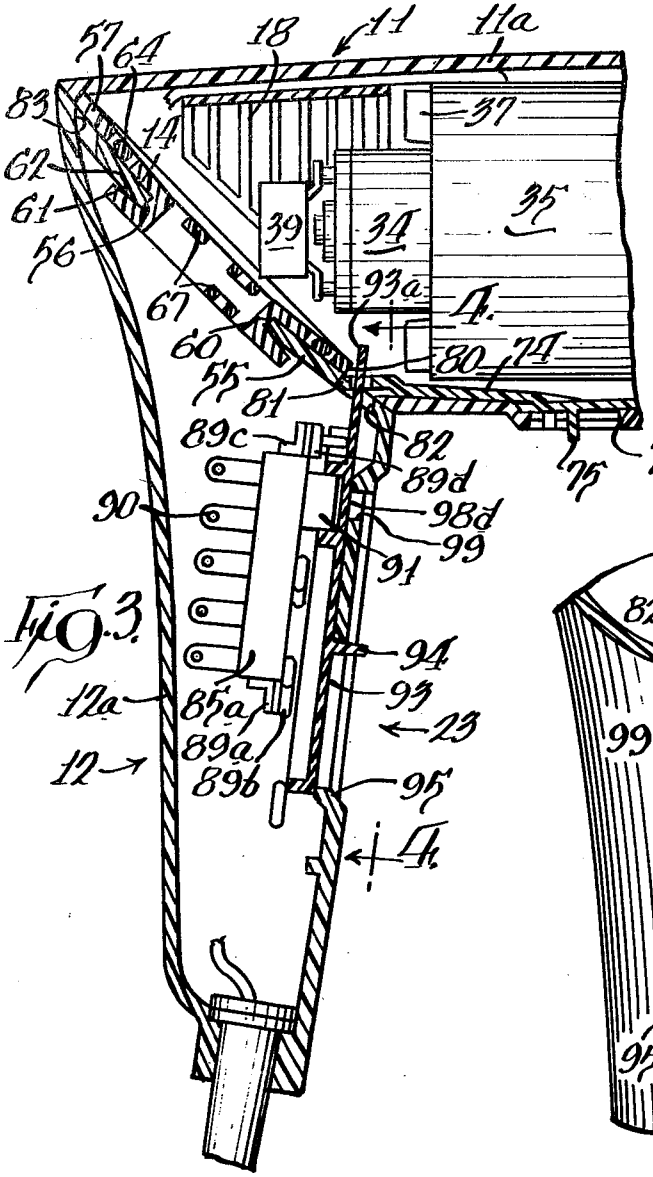
FIG. 3 is a partial section view similar to FIG. 2 with the electrical switch assembly shown in one of its high-wattage limit positions.

As previously noted, the hair dryer appliance 10 of the present invention includes the handle portion 12 which can be rotated through a swivel connection with respect to the cylindrical body portion 11 in order to alternate the hair dryer between a gun-type blower/dryer configuration and an in-line styler/dryer configuration. In order to accomplish this rotation, the handle housing 12*a* is provided at its end adjacent the junction plane 14 with an end wall 55 having a centrally disposed circular hole 60 defining an annular edge 56. As best shown in FIG. 2 or FIG. 3 or FIG. 5, the cylindrical body housing 11*a* adjacent the junction plane 14 is provided with a centrally bored end wall 57 having a pulley type formation projecting outwardly therefrom. The pulley type formation is characterized by an enlarged head 61 with an annular slot 62 being defined between the head 61 and the end wall 57. The annular edge 56 of the hole 60 in the end wall 55 of the handle housing 12*a* rotatably fits within the annular slot 62 formed at the end of the cylindrical body housing 11*a* to provide the swivel connection therebetween. In order to insure proper tension between the handle and the cylindrical body housings, there are also provided resilient tabs 64 formed in the end wall 57 of the body portion housing 11*a*. The tabs 64 abut the end wall 55 of the handle housing 12*a* thereby maintaining the desired pressure between the handle and cylindrical body housings. Thus, with the junction plane 14 being at approximately 45° with respect to the cylindrical body and handle axes, rotation of the handle 180° about its own axis will change the hair dryer 10 from the gun-type configuration to the in-line configuration or the reverse thereof. The end wall 57 of the cylindrical body portion 11*a* is also provided with a series of projections of fingers 67 which extend into the central bore formed therein and through which an electrical cord 68 can be woven and secured, as is best shown in FIG. 2.

In order to lock the relative positions of the handle portion 12 with respect to the cylindrical body portion 11 in the two alternative configurations of the hair dryer appliance, there is provided a locking lever 74 best shown in FIG. 2 and FIG. 5 at the bottom of the cylindrical body portion 11. The locking lever 74 carries the operating button 75 which extends outwardly through an opening 73 in housing 11*a*. The locking lever 74 is spring biased rearwardly by a coil spring 76 which is seated between a locking lever extension 77 and a stop member 78 formed in the housing 11*a*.

The actual locking operation is accomplished by a rear end 81 of the locking lever 74 extending through a passageway 80 formed in the end wall 57 of the housing 11*a* and into either a slot 82 or a slot 83, both of which are formed in the end wall 55 of the handle housing 12*a* in diametrically opposite positions, slot 82 being aligned with passageway 80 when the hair dryer appliance is in its gun-type blower/dryer configuration and slot 83 being aligned with passageway 80 when the handle 12 has been rotated to the in-line styler/dryer configuration. Thus, as best shown in FIG. 2 with the blower/styler configuration, rear end 81 of the locking lever 74 is spring biased within slot 82 and prevents any rotation of the handle 11 with respect to the body portion 12. In the styler/dryer configuration, the locking mechanism, as shown in FIG. 5, has rear end 81 of the locking lever 74 biased into engagement within slot 83. In order to alternate the hair dryer appliance from the blower/dryer configuration to the styler/dryer configuration, for example, the user pushes the locking lever forward by pushing the operating button 75 toward the right, as shown in FIG. 2, thereby disengaging end 81 from the elongated slot 82, and rotates the handle portion 12. As the handle portion is rotated into its in-line position with the cylindrical body portion 11, the elongated slot 83 will become aligned with the passageway 80 thereby allowing the spring biased locking lever 74 to be inserted therein, thus locking the appliance in its styler/dryer configuration.

The hair dryer appliance of the present invention may be operated at three different heating levels and two different fan speeds, the faster fan speed being used with the high and medium heating levels. In order to operate the hair dryer, there is provided a four position slide switch 85, as part of the switch assembly 23. The mechanical structure of the switch assembly 23 is best shown in FIGS. 2, 3, 4, 5 and 6. A switch housing 85*a* is secured within the handle housing 12*a* in a known manner by housing projections and supporting members 89*a*, 89*b*, 89*c* and 89*d*. Electrical connector tabs or contacts 90 are located on the back side of the switch housing 85*a*. On the opposite side of switch housing 85*a* there is located a slide button 91 for varying the several electrical positions of the switch 85. Overlying the slide button 91 there is provided an elongated switching lever 93 with a raised button portion 94. The button portion 94 extends through an opening 95 provided in the housing 12*a*. As the button portion 94 is moved back and forth by the consumer, the slide button 91 of switch 85 will correspondingly be moved to its various positions. Indicia marking the "off", "low", "medium", and "high" positions of the switch 85 may be imprinted on the outer face of the switching lever 93 at locations 98*a*, 98*b*, 98*c* and 89*d*, respectively. The particular indicia corresponding to the location of the switching lever 93 and the corresponding electrical position of slide switch button 91 is readily visible through an opening 99 provided in the housing 12*a*.

Figure 4:
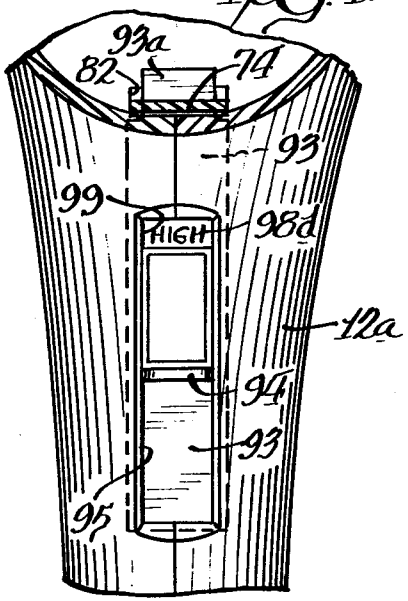
FIG. 4 is a fragmentary view, partially in vertical section, taken generally on line 4—4 of FIG. 3.

For example, FIG. 4 shows the switch assembly 23 in its high positions wherein the "high" indicia located at location 98*d* of lever 93 is visible through opening 99. Similarly, the "medium" indicia at location 98*c* is shown to be visible in FIG. 6 with the switch assembly in its medium position. When the hair dryer appliance 10 is in its gun-type blower/dryer configuration, and the switching lever 93 is moved into its position for the high wattage setting, as shown in FIG. 3, the end 98*a* of switching lever 93 adjacent indicia 98*a* protrudes through both the elongated slot 82 in handle casing 12*a* and an opening 101 provided in the rear end 81 of the locking lever 74, locking lever 74 also having its rear end 81 disposed in slot 82 in handle casing 12*a*, as previously described herein. With this structural arrangement, with the hair drying appliance 10 in its gun-type blower/dryer configuration and the switching lever 93 in its high wattage position, the locking member 74 may not be disengaged from its locking engagement with the handle casing 12*a* and the handle 12 may therefore not be rotated into its in-line styler/dryer configuration, thus insuring against highest wattage use of the appliance when in its styler/dryer configuration, as will be discussed further herein. Further, with the clearance provided for end 93*a* of switching lever 93 through slot 82 and opening 101, the full range of operation of lever 93 and thus slide button 91 is allowed thereby permitting all three wattage levels to be used.

Figure 6:
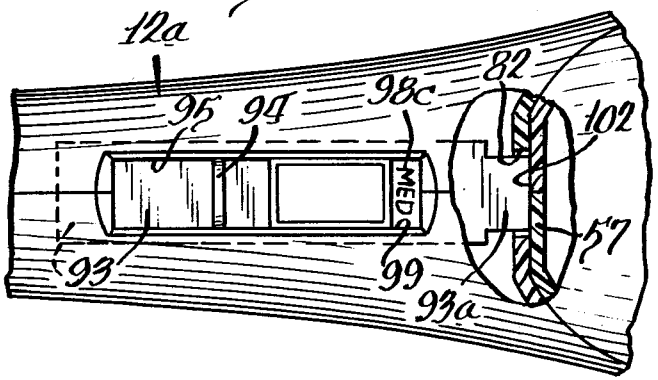
FIG. 6 is a fragmentary view, partially in horizontal section, taken generally on line 6—6 of FIG. 5.

With the hair dryer in its in-line styler/dryer configuration, it is not desirable to allow operation of the appliance 10 in its highest wattage mode in that with the air outlet 15 being blocked and only air outlet 16 being open there will be insufficient continuous air flow to prevent an undesirable heat build-up. Therefore, in order to prevent use of the appliance 10 in its high wattage mode when in its styler/dryer configuration, the movement of switching lever 93 is blocked before its high wattage position can be reached. Specifically, if the switching lever 93 is moved toward the right, as shown in FIG. 5 and FIG. 6, in an attempt to obtain the high wattage setting, the end 93*a* of lever 93 will extend through slot 82 in handle casing 12*a* but will then abut a portion 102 of the end wall 57 of the housing 11*a*, thereby preventing any further movement of the switching lever 93 into its highest wattage position. As such, all three wattage levels are useable with the hair dryer in its blower/dryer configuration whereas only the low and medium wattage levels are obtainable in the styler/dryer configuration.

While there has been shown and described a single embodiment of the present invention, it will be apparent to those skilled in the art that numerous changes and modifications may be made without departing from the invention into broader aspects and it is, therefore, contemplated in the appended claims to cover all such changes and modifications which fall within the true spirit and scope of the present invention.

What is claimed as new and desired to be secured by Letters Patent of the United States is:

1. In a combination hair drying appliance of the type having a housing, a motor actuated fan mounted in said housing, air inlet and air outlet means disposed at opposite ends of said housing, heater means mounted in said housing between said fan and said air outlet means, said housing being generally cylindrical in configuration and having an elongated handle rotatably connected to the air inlet end thereof with a junction plane between said cylindrical housing and said handle being disposed at an angle of approximately 45° with respect to the axis of said cylindrical housing, said handle being rotatable with respect to said cylindrical housing between a first position in which said handle is generally perpendicular to said cylindrical housing and a second position in which said handle is in coaxial longitudinal end-to-end alignment with said cylindrical housing, and a single slidably mounted locking lever for latching said handle in either said first or second positions, the improvement which comprises a single electrical switch for controlling said heater means slidably mounted on said handle and having "high", "medium", "low", and "off" positions, said switch being movable between all of said heat positions when said handle is in said first generally perpendicular position, and blocking means provided on said cylindrical housing whereby said handle is in said second aligned position said switch engages said blocking means whereby said switch is not movable into said "high" heat position.

2. A combination hair drying appliance improvement as claimed in claim 1 wherein said locking lever is slidably mounted in said cylindrical housing longitudinally thereof and is biased rearwardly of said housing into latching engagement in either one of two spaced apart slots provided in said handle which are alignable with said locking lever in said first and second positions of said handle relative to said housing, and wherein said switch is interengageable with said locking lever when said handle is in said first generally perpendicular position and said switch is in its "high" heat position in a manner whereby said locking lever may not be retracted from said latching engagement to permit rotation of said handle into said second aligned position while said switch is in its "high" heat position.

3. A combination hair drying appliance improvement as claimed in claim 2 wherein the rear end of said locking lever, when latchingly engaged in one of said handle slots with said handle in said first generally perpendicular position relative to said cylindrical housing, extends across the path of movement of said switch when said switch is moved into its "high" heat position, and wherein said rear end of said locking lever is provided with an opening through which an end portion of said switch projects during movement of same into its "high" heat position, whereby to prevent disengagement of said locking lever from said handle slot and rotation of said handle into said second aligned position until said switch is moved into either its "medium", "low", or "off" positions, in all of which positions said end portion of said switch is spaced from said locking lever, whereby this hair drying appliance is limited to a lower range of heat settings with said handle in said second aligned position than the higher range of heat settings available with said handle in said first generally perpendicular position relative to said cylindrical housing.

4. In a combination hair drying appliance of the type having a cylindrical housing, a handle mounted on the rear end thereof for rotation between a first pistol-grip position and a second position in longitudinal coaxial end-to-end alignment with said housing, and air inlet and two air outlets with one outlet being disposed at the forward end of said cylindrical housing and the other outlet being disposed in the bottom wall of said housing adjacent the forward end thereof, a motor driven fan in said housing, heater means in said housing between said fan and said air outlets, and a locking lever on said housing for latching said handle in each of its two positions, the improvement which comprises a single switch on said handle for controlling said heater means and having a plurality of heat settings, and means permitting use of a full range of said switch heat settings when said handle is in its pistol-grip position but limiting the heat range to the lower heat settings when said handle is in its aligned position.

5. A combination hair drying appliance improvement as claimed in claim 4 wherein said heat range limiting means comprises blocking means on said housing preventing movement of said switch into its highest heat setting when said handle is in said aligned position, and means for interengaging said switch when in its highest heat setting with said locking lever when said handle is in its pistol-grip position whereby to prevent latching disengagement of said locking lever from said handle and rotation of said handle into said aligned position as long as said switch is in its highest heat setting.

* * * * *